US007891592B2

(12) United States Patent
Yamamoto et al.

(10) Patent No.: US 7,891,592 B2
(45) Date of Patent: Feb. 22, 2011

(54) VIBRATORY HOPPER AND SHREDDER IN COMBINATION

(75) Inventors: David K. Yamamoto, Paris (CA); James A. Leitch, Cambridge (CA)

(73) Assignee: Shred-Tech Corporation, Cambridge, Ontario (CA)

( * ) Notice: Subject to any disclaimer, the term of this patent is extended or adjusted under 35 U.S.C. 154(b) by 50 days.

(21) Appl. No.: 12/413,212

(22) Filed: Mar. 27, 2009

(65) Prior Publication Data

US 2010/0243778 A1 Sep. 30, 2010

Related U.S. Application Data

(60) Provisional application No. 61/040,471, filed on Mar. 28, 2008.

(51) Int. Cl.
*B02C 18/22* (2006.01)

(52) U.S. Cl. ..... 241/101.74; 241/224; 241/236

(58) Field of Classification Search ..... 241/224, 241/236, 100, 101.74
See application file for complete search history.

(56) References Cited

U.S. PATENT DOCUMENTS 3,186,651 A * 6/1965 Briolini ..... 241/186.2
5,529,250 A * 6/1996 Pallmann ..... 241/57

FOREIGN PATENT DOCUMENTS

DE 3028342 * 4/1982

* cited by examiner

*Primary Examiner*—Mark Rosenbaum
(74) *Attorney, Agent, or Firm*—Daryl W. Schnurr

(57) ABSTRACT

A mobile shredder has a shredder mounted in a truck box in combination with a vibratory hopper. The vibratory hopper is open on one side and opens into a fixed hopper. The fixed hopper is mounted on the shredder and is shaped to direct material to be shredded into the shredder. The vibratory hopper and the fixed hopper are located immediately adjacent to one another, but slightly apart from one another, so that vibration of the vibratory hopper does not cause vibration of the fixed hopper.

23 Claims, 8 Drawing Sheets

VIBRATORY HOPPER AND SHREDDER IN COMBINATION

Applicant claims the benefit of U.S. Provisional Application Ser. No. 61/040,471 filed on Mar. 28, 2008

BACKGROUND OF THE INVENTION

1. Field of the Invention

This invention relates to a vibratory hopper and shredder in combination where the vibratory hopper has one or more vibrators thereon. This invention further relates to a hopper and shredder in combination, where the hopper has a vibratory section and a fixed section.

2. Description of the Prior Art

Feed hoppers with vibrators thereon are known. McGregor U.S. Pat. No. 4,944,334 issued Jul. 31, 1990 describes a vibrating hopper and auger feed assembly for conveying finely powdered or particulate matter from a storage bin to a bag filling and handling station. The vibrator is located on a cone-shape and the vibration of the hopper is said to de-aerate the product.

SUMMARY OF THE INVENTION

It is an object of the present invention to provide a hopper and shredder in combination, where the hopper has a vibratory section opening into a fixed section that is attached to the shredder. It is a further object of the present invention to provide a vibratory hopper and shredder in combination in which the vibratory hopper opens into a fixed hopper located between the vibratory hopper and the shredder and material from the vibratory hopper flows into the shredder through the fixed hopper, the vibratory hopper being constructed to vibrate and the fixed hopper being constructed not to vibrate.

A vibratory hopper and a shredder in combination is used for shredding paper material, and comprises a vibratory hopper for receiving material to be shredded. The vibratory hopper has an open side that opens into a fixed hopper. The fixed hopper receives the material from the vibratory hopper and is mounted on a frame of the shredder, and the fixed hopper is shaped to direct material from the vibratory hopper into the shredder. The vibratory hopper has at least one vibrator thereon, the vibratory hopper being supported by the at least one vibration damper so that the vibration of the vibratory hopper does not cause vibration of the fixed hopper. The open side of the vibratory hopper overlaps slightly with the fixed hopper. The vibratory hopper is spaced slightly apart from the fixed hopper with openings therebetween being sufficiently filled with flexible barriers to substantially prevent paper from exiting through the openings without causing the fixed hopper to vibrate as the vibratory hopper vibrates.

A hopper and shredder in combination is used for shredding paper material and comprises a hopper for receiving the material to be shredded. The hopper is shaped to direct material to the shredder, and the hopper has a first section and a second section. The second section is mounted on the shredder, the first section being mounted immediately adjacent to the second section and having an open side that opens into the second section. The open side overlaps slightly with the second section. The first section is spaced slightly apart from the second section, with gaps located between the first section and the second section, being filled with flexible barriers to substantially prevent paper from exiting through the openings. The first section is constructed and mounted to vibrate relative to the second section and is shaped so that material from the first section passes through the second section to the shredder.

DETAILED DESCRIPTION OF A PREFERRED EMBODIMENT

Figure 1:
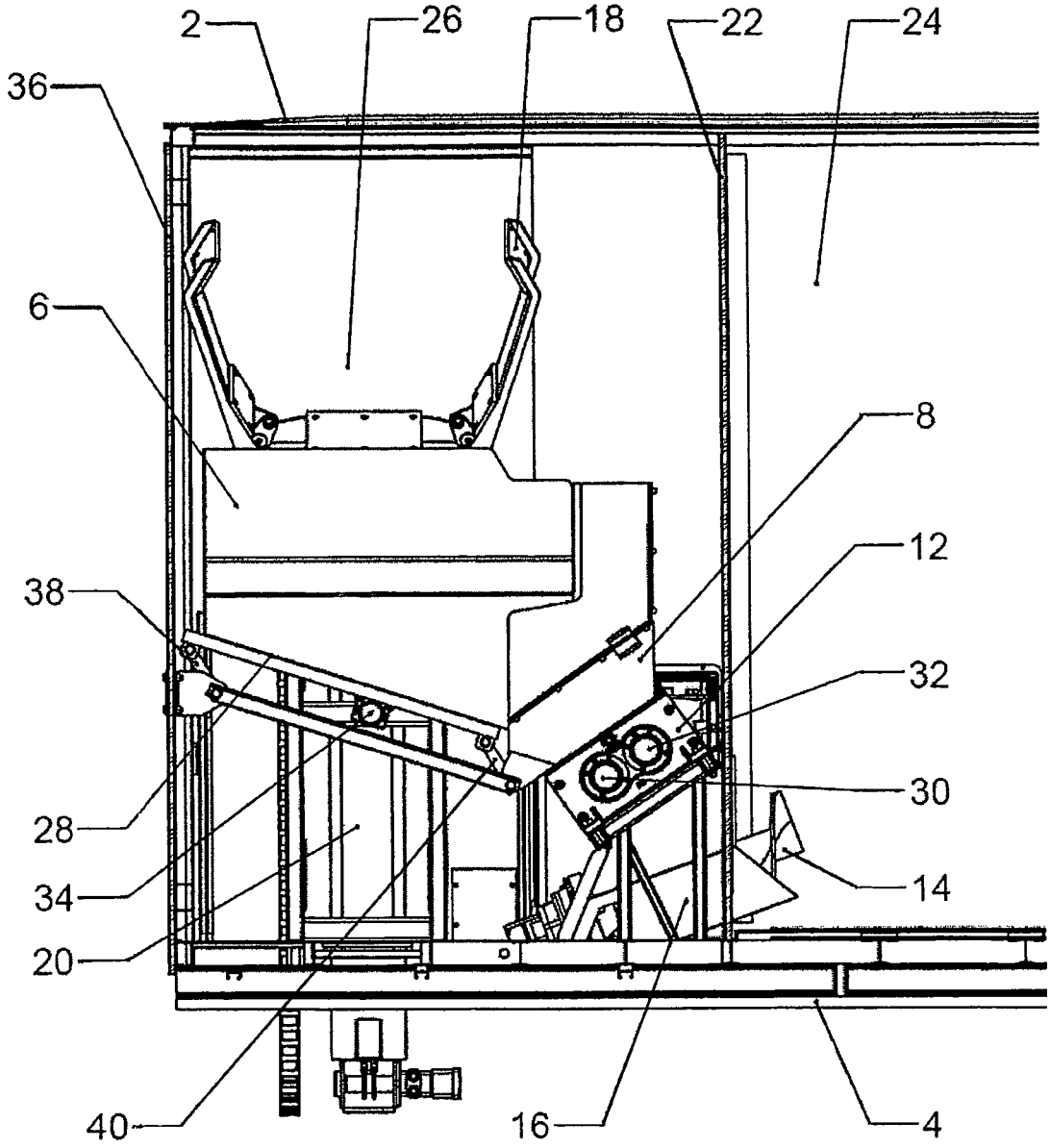
FIG. 1 is a side view of a vibratory hopper and shredder installed in a truck body.

In FIG. 1, a truck box 2 of a truck body 4 has a vibratory hopper 6 with an open top (not shown in FIG. 1) and an open side (not shown in FIG. 1). The open side faces a fixed hopper 8, which is mounted on a frame 10 of a shredder 12. The shredder is mounted at an angle of approximately 45 degrees to horizontal toward the vibratory hopper and fixed hopper. An auger 14 mounted in a chute 16 beneath the shredder 12. A bin gripper 18 is mounted on a shaft 20 upon which the bin gripper 18 rides to lift a bin (not shown) from the ground (not shown) and to tip the contents of the bin into the vibratory hopper. A vertical wall 22 divides a rear storage section 24 of the truck body 2 from the front shredder section 26. The vibratory hopper has a bottom surface 28 that is sloped downward toward the fixed hopper 8 and shredder 12. The shredder 12 can be of various designs, the shredder shown having two parallel drives 30, 32 therein. Beneath the sloped bottom surface 28 of the vibratory hopper 6, there is mounted a vibrator 34. The vibratory hopper 6 is mounted to a front wall 36 of the truck box 2 by means of two vibration dampers 38 (only one of which is shown in FIG. 1). The rear portion of the vibratory hopper 6 is mounted to the fixed hopper 8 using two vibration dampers 40 (only one of which is shown in FIG. 1). The vibration dampers prevent the vibratory hopper from causing the truck box to vibrate or from causing the fixed hopper to vibrate with the vibration of the vibratory hopper 6. The shredder is a mobile shredder and the vibratory hopper is particularly suited to be used in truck bodies because of the size of the hopper can be increased over a conventional hopper in the limited space available within a truck body.

Figure 2:
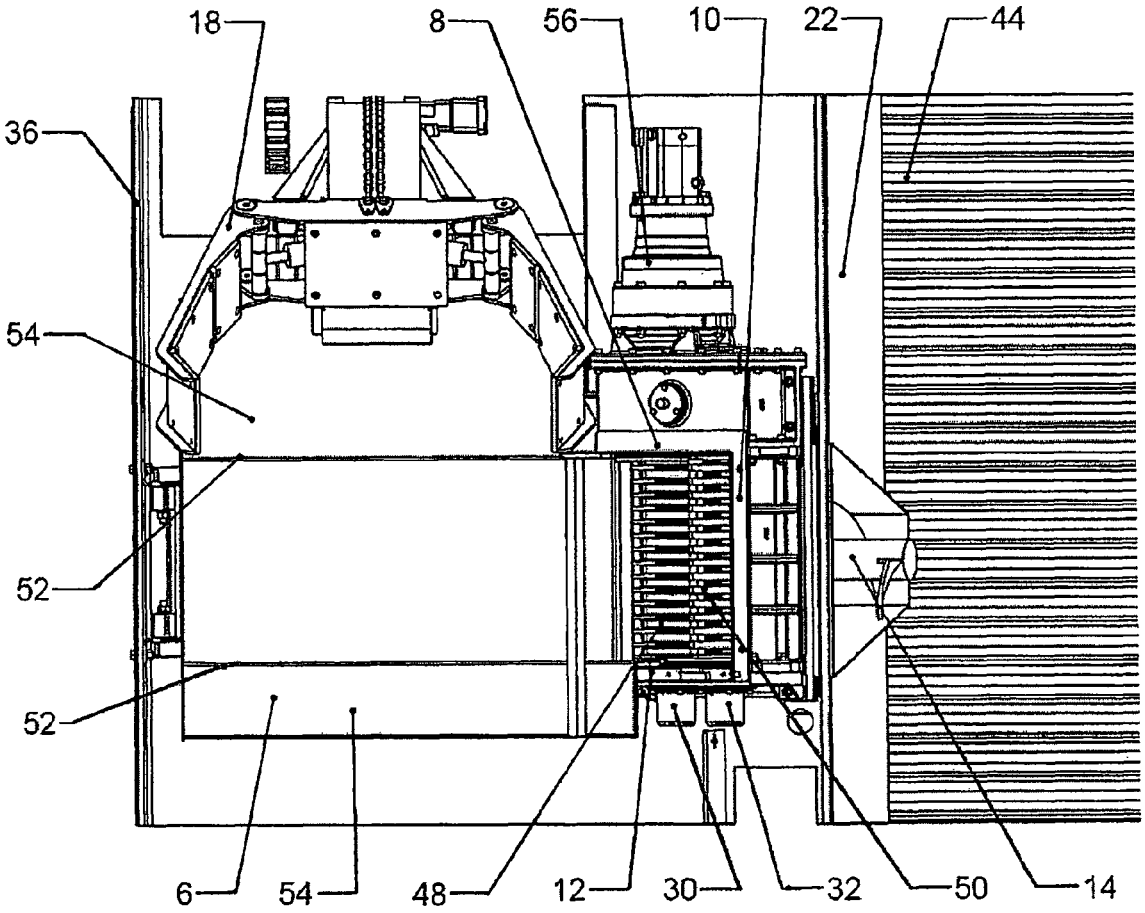
FIG. 2 is a top view of the vibratory hopper and shredder.

In FIG. 2, there is shown a partial top view of the vibratory hopper/shredder arrangement of FIG. 1. The storage area 24 of the truck body 2 has a walking floor 44 therein. The vibratory hopper 6 has vertical side walls 52 in a lower portion thereof, and upper side walls 54 that slope outward relative to one another. The same reference numerals are used in FIG. 2 as those used in FIG. 1 for those components that are identical. The shredder 12 has a drive 56.

Figure 3:
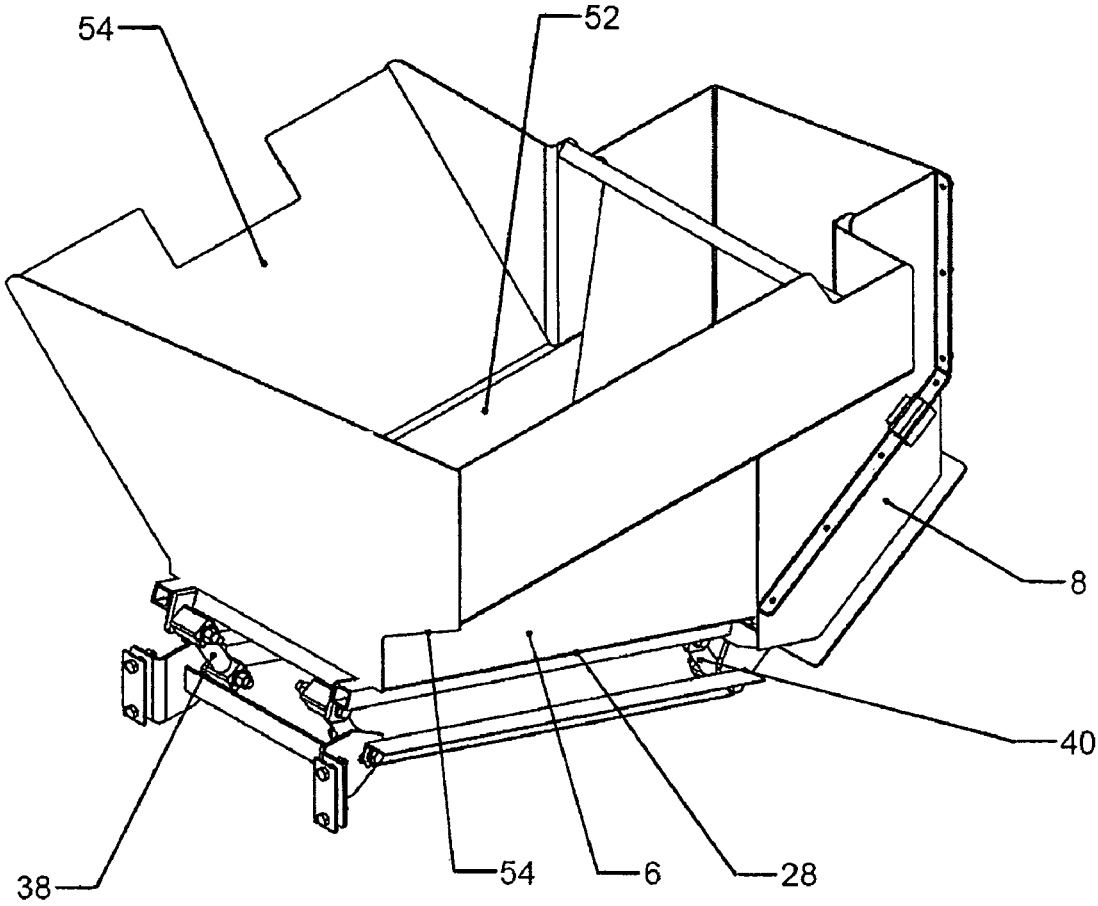
FIG. 3 is a perspective view of the vibratory hopper and fixed hopper when viewed from the upper right.
Figure 4:
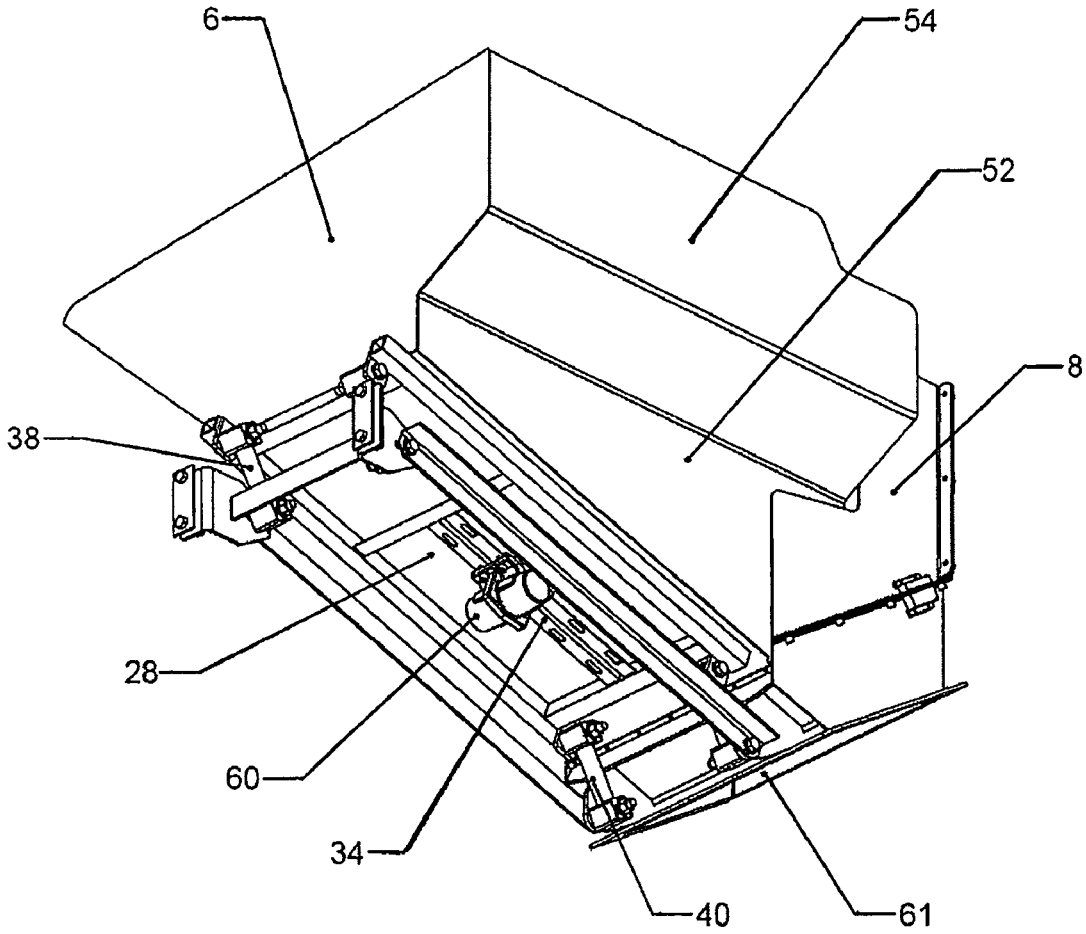
FIG. 4 is a perspective view of the vibratory hopper and fixed hopper when viewed from beneath.

In FIGS. 3 and 4, it can be seen that the vibratory hopper 6 is sized to fit slightly inside the fixed hopper 8, and the side walls of the vibratory hopper 6 overlap slightly with the side walls of the fixed hopper. The fixed hopper is spaced apart slightly from the side walls of the vibratory hopper and bottom wall of the vibratory hopper so that as the vibratory hopper vibrates, the vibratory hopper will not cause the fixed hopper to vibrate. The vibratory hopper is affixed to the fixed hopper by vibration dampers 40, both of which can be seen in FIG. 4.

In FIG. 4 it can be seen that there is a second vibrator 60 mounted back to back with the vibrator 34. Preferably, the second vibrator 60 is oriented to cancel out or reduce the lateral vibration of the vibratory hopper 6, caused by the vibrator 34 and to increase the longitudinal vibration (toward the fixed hopper 8) caused by the vibrator 34. The fixed hopper 8 has an opening 61 in a bottom thereof, which is located above the shredder (not shown) when assembled. The same reference numerals are used in FIGS. 3 and 4 as those used in FIGS. 1 and 2 for those components that are identical.

Figure 5:
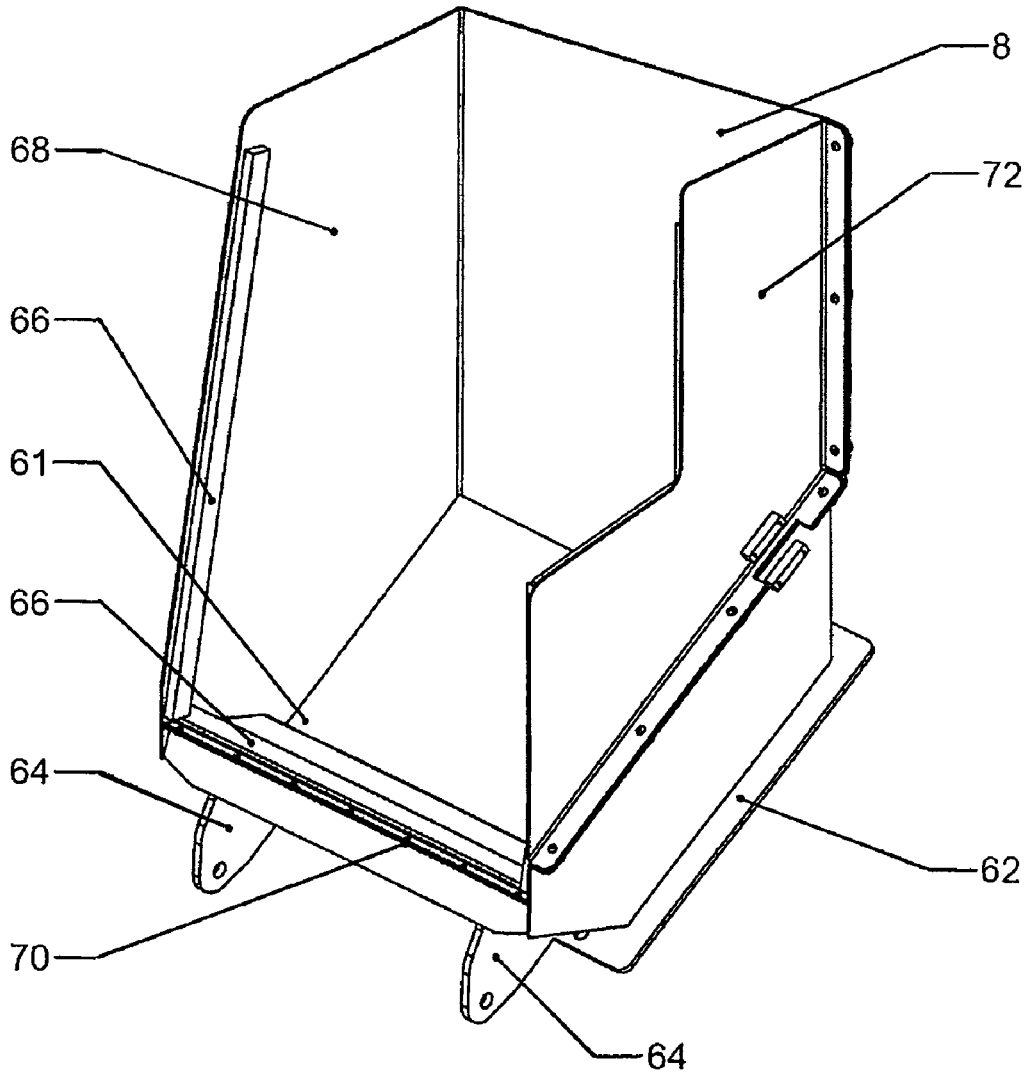
FIG. 5 is a perspective view of the fixed hopper.
Figure 6:
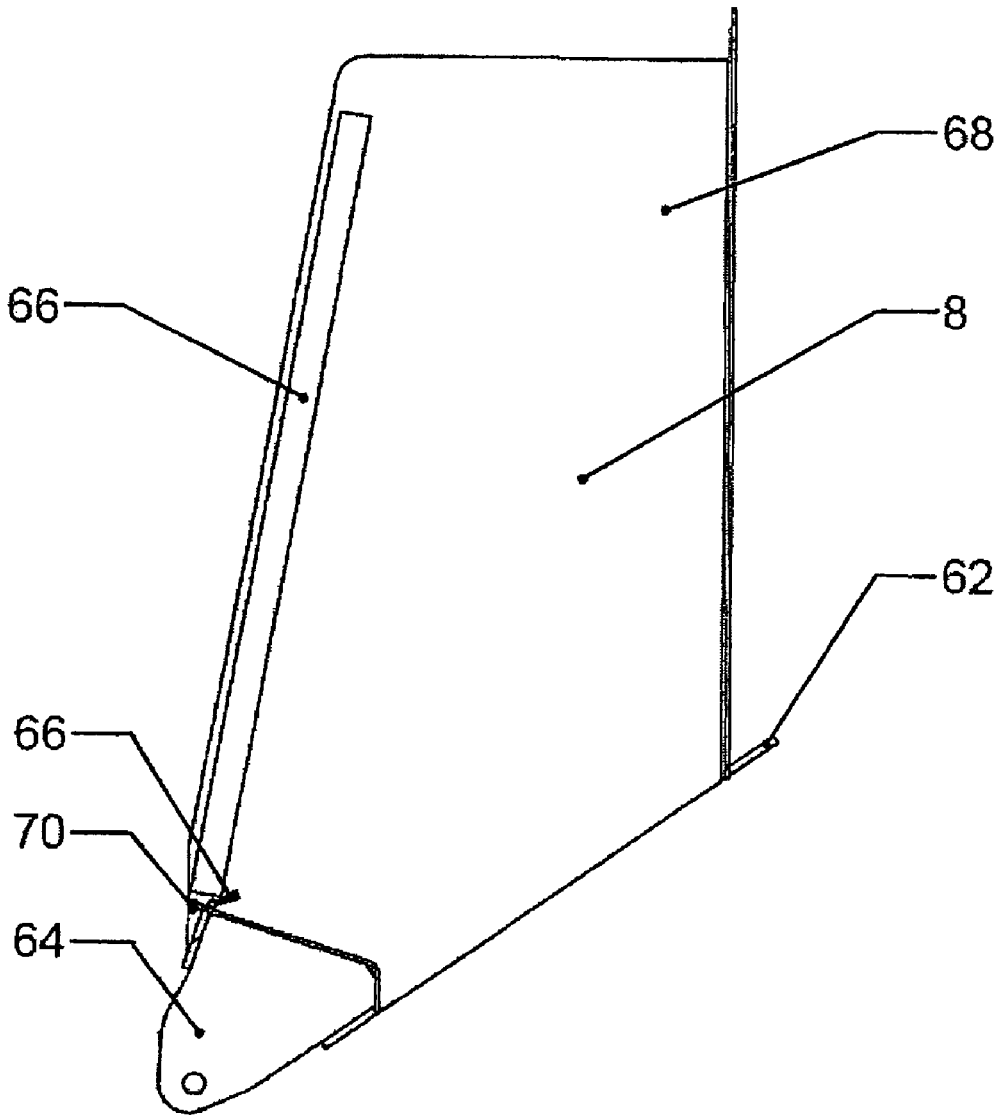
FIG. 6 is a sectional view of the fixed hopper.

In FIG. 5, there is shown a perspective view of the fixed hopper 8 having a flange 62 around a lower edge, said flange 62 being sized to fit onto the frame of the shredder (not shown in FIG. 5), located on the bottom thereof, as shown in FIG. 5. The fixed hopper 8 has a bracket 64 at a lower front thereof to receive the vibration damper (not shown in FIG. 5). Inside the fixed hopper 8, there are located flexible barriers. The flexible barriers are preferably brushes 66, only two of which are shown. Other flexible barriers can be used in place of brushes. The flexible barriers must be sufficiently rigid to prevent paper from exiting between the vibratory hopper and the fixed hopper and sufficiently flexible that the vibration of the vibratory hopper does not cause the fixed hopper to vibrate. There are two brushes along an inner surface 68 of each side and one brush 66 along a bottom front of the fixed hopper 8. Rivets 70 that hold the brush 66 that cannot be seen in FIG. 5 are located along an outer surface of a side wall 72. The brushes 66 close off the openings between the bottom of the fixed hopper 8 and the vibratory hopper 6 to prevent paper passing from the vibratory hopper 6 to the fixed hopper 8 from exiting through those openings. At the same time, the brushes 66 prevent the vibration caused by the vibratory hopper 6 from being passed onto the fixed hopper 8. If the hoppers 6, 8, were rigidly connected to one another, the fixed hopper 8 would vibrate from the vibrations of the hopper 6. The sectional side view shown in FIG. 6 has reference numerals that are the same as the reference numerals of FIG. 5 for those components that are identical.

Figure 7:
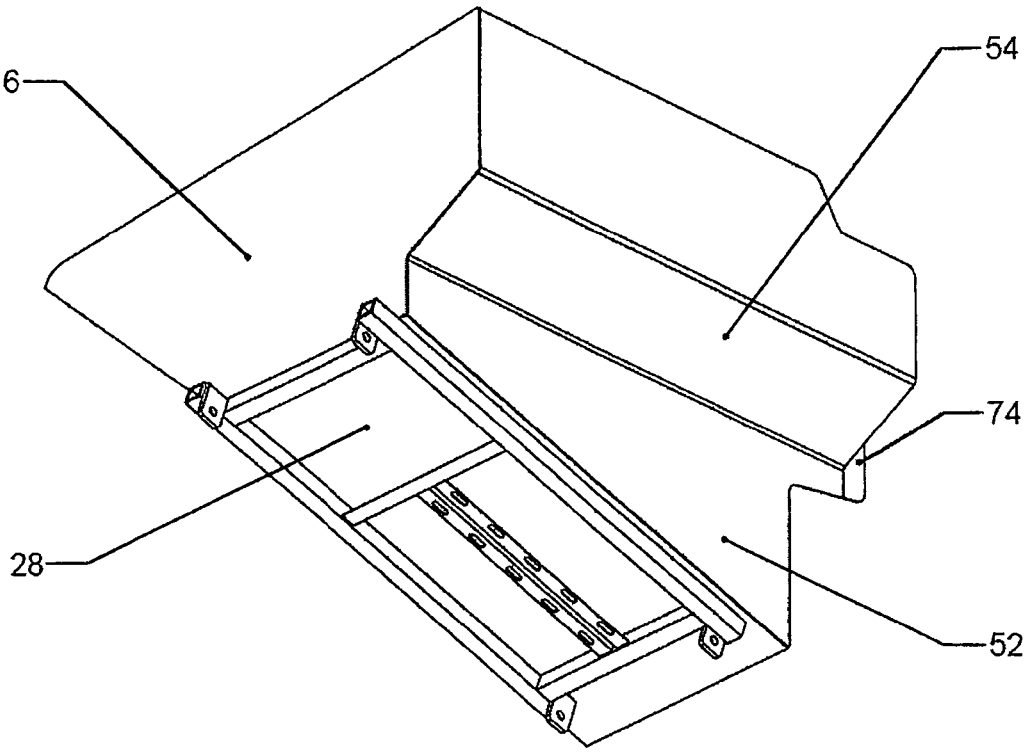
FIG. 7 is a perspective view of the vibratory hopper when viewed from beneath.

In FIG. 7, there is shown a perspective view from beneath the vibratory hopper 6. The same reference numerals are used in FIG. 7 as those used in FIGS. 1, 2 and 4. The shape of a rear edge 74 of the vibratory hopper 6 that is located partially inside the fixed hopper 8 (not shown in FIG. 7) when the vibratory hopper and fixed hopper are assembled together can be seen in FIG. 7.

Figure 8:
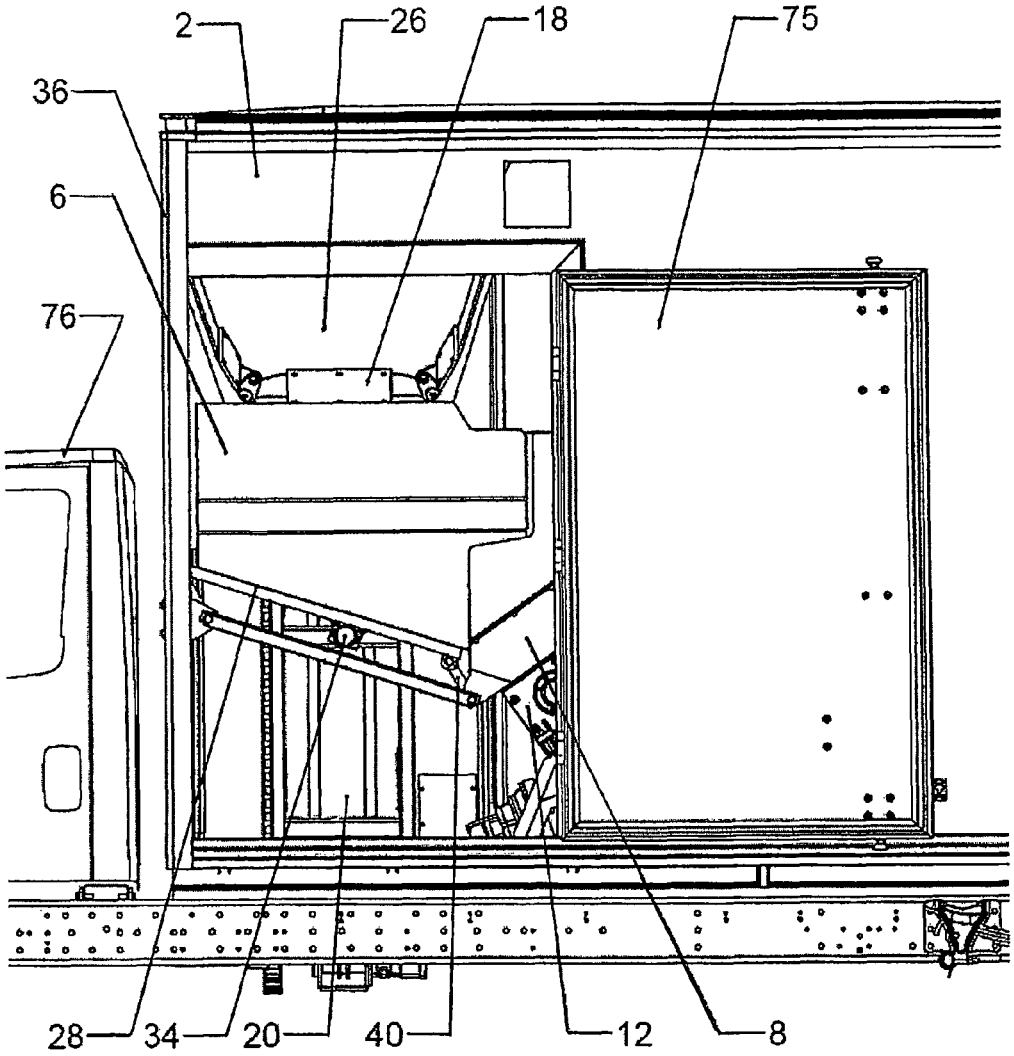
FIG. 8 is a side view of a vibratory hopper and shredder mounted in a truck body as viewed through an open door of the truck body.

In FIG. 8, the vibratory hopper 6, fixed hopper 8 and shredder system are shown through an open door 75 of the truck box 2. The fixed hopper 8 and shredder 12 are only partially shown. A cab 76 of the truck is also shown. The same reference numerals are used in FIG. 8 as those used in FIG. 7 for those components that are identical.

The vibratory hopper and shredder in combination as shown and described, result in the vibratory hopper completely emptying of paper. The fixed hopper 8 closes off an end of the vibratory hopper 6. The shredder 12 is located beneath the fixed hopper 8 and is conventional. The fixed hopper does not vibrate due to the vibration of the vibratory hopper, but the vibratory hopper does vibrate. Alternatively, the hopper can be described as a single hopper having two sections, a first vibratory section, and a second fixed section.

The vibratory hopper can be vibrated by various means and the term "vibrator" shall be defined to include any device that causes the vibratory hopper to vibrate relative to the fixed hopper.

The hopper has four side walls, an open top and a bottom. A first wall of the four walls is located on the first section and the second wall of the four walls is located on the second section. The second section is located on the shredder. A third wall and a fourth wall are each partially on the first section and partially on the second section, the third and fourth walls being divided walls and being separated from one another between the first section and the second section, except for the flexible barriers therebetween.

When installing a mobile paper shredding system into a truck body, there are vertical height restraints that must be complied with. The hopper must be shallow enough to fit between the shredder and the roof of the truck body and must be a sufficient distance beneath the truck body to receive a full container of material. With the vibratory hopper or hopper having a vibratory section of the present invention, a floor of the hopper can have a much gentler slope than conventional hoppers. The gentler slope results in the hopper having increased volume with the same height as conventional hoppers. The increased volume allows the height of the vibratory hopper or vibratory section to be reduced compared to conventional hoppers, and still have the same volume as conventional hoppers. This provides a greater distance between the top of the hopper and the roof of the truck body, or, alternatively, allows a greater distance for the shredder system located beneath the hopper. For example, the hopper must be large enough to receive a full ninety six gallon container of material in one dumping action. The vibratory hopper or vibratory section has a floor with a slope of eighteen degrees to the horizontal compared to the minimum slope angle for non-vibratory hoppers, which is approximately thirty-nine degrees to the horizontal.

The low angle of the vibratory hopper or the vibratory section in its position beside the shredder causes it to carry the majority of the paper weight load. Conventional hoppers with the steeper sloped floor have much of the paper loaded directly over the cutting chamber of the shredder and the weight of the paper applies pressure on the paper that is immediately adjacent to the knives of the shredder and does not allow for easy reorientation of the paper to get into a bite of a knife. The vibratory hopper or vibratory section of the present invention reduces the weight load of the paper on the knives of the shredder as the paper remains in the vibratory hopper or vibratory section of the hopper for a much longer period. Since there is much less pressure on the paper that is immediately adjacent to the knives of the shredder, it is easier for the paper to reorient freely to get into the bites of the knives and shredding performance is improved.

The vibratory hopper and fixed hopper can be sized so that the fixed hopper fits partially inside the vibratory hopper. A flexible sealing arrangement can be used to smooth the transition between the two hoppers. However, since the material to be shredded moves from the vibratory hopper to the fixed hopper, it is preferable to have the vibratory hopper fit partially inside the fixed hopper.

We claim:

1. A vibratory hopper and a shredder in combination, said combination being used for shredding paper material and comprising:

a. a vibratory hopper for receiving said material to be shredded, said vibratory hopper having an open side that opens into a fixed hopper;

b. said fixed hopper receiving said material from said vibratory hopper and being mounted on a frame of said shredder and being shaped to direct material from said vibratory hopper into said shredder;

c. said vibratory hopper having at least one vibrator thereon, said vibratory hopper being supported by at least one vibration damper so that vibration of said vibratory hopper does not cause vibration of said fixed hopper;

d. said open side of said vibratory hopper overlapping slightly said fixed hopper, said vibratory hopper being spaced slightly apart from said fixed hopper with openings therebetween being sufficiently filled with flexible barriers to substantially prevent paper from exiting through said openings without causing said fixed hopper to vibrate as said vibratory hopper vibrates.

2. A combination as claimed in claim 1, wherein said open side of said vibratory hopper is sized to fit partially within said fixed hopper.

3. A combination as claimed in claim 2, wherein said at least one vibration damper is at least two vibration dampers and there are two vibration dampers connected between said vibrator hopper and said fixed hopper.

4. A combination as claimed in claim 2, wherein said vibratory hopper is connected to said fixed hopper by said at least one vibration damper.

5. A combination as claimed in claim 4, wherein said vibratory hopper and said fixed hopper having vertical side walls in an area where said vibratory hopper meets said fixed hopper when said vibratory hopper and fixed hopper are in an upright position, said side walls of said fixed hopper being further apart than said side walls of said vibratory hopper in said area.

6. A combination as claimed in claim 5, wherein said vibratory hopper has side walls that diverge from one another for at least a part of their length, outside of said area.

7. A combination as claimed in claim 6, wherein said at least two vibration dampers are four vibration dampers supporting said vibratory hopper, a front of said hopper being connected to a truck box through two vibration dampers, said shredder being a mobile shredder.

8. A combination as claimed in claim 4, wherein said vibratory hopper has a bottom that slopes downward to said fixed hopper.

9. A combination as claimed in claim 8, wherein said shredder has at least one rotatable shaft that extends from side to side relative to said fixed hopper.

10. A combination as claimed in claim 9, wherein a rear of said shredder is tilted upward relative to said vibratory hopper and to said fixed hopper.

11. A combination as claimed in claim 10, wherein said shredder has two rotatable shafts having knives thereon, said knives partially overlapping with one another.

12. A combination as claimed in claim 11, wherein a plane conforming to said bottom of said vibratory hopper extends to include an imaginary line along said shredder at a top of said knives where said knives intersect one another.

13. A combination as claimed in claim 1, wherein said flexible barriers are brushes.

14. A combination as claimed in claim 1, wherein said at least one vibrator is mounted on said vibratory hopper, said at least one vibrator being two vibrators, said two vibrators being mounted back to back so that side to side vibration is minimized and longitudinal vibration is maximized.

15. A hopper and shredder in combination, said combination being used for shredding paper material and comprising:

a. a hopper for receiving said material to be shredded, said hopper being shaped to direct said material to said shredder; and b. said hopper having a first section and a second section, said second section being mounted on said shredder, said first section being mounted immediately adjacent to said second section and having an open side that opens into said second section, said open side overlapping slightly with said second section, said first section being spaced slightly apart from said second section, with gaps located between said first section and said second section being filled with flexible barriers to substantially prevent paper from exiting through said openings, said first section being constructed and mounted to vibrate relative to said second section and being shaped so that said material from said first section passes through said second section to said shredder.

16. A combination as claimed in claim 15, wherein said first section is sized to fit partially within said second section.

17. A combination as claimed in claim 16, wherein said hopper has four walls, an open top and a bottom, a first wall of said four walls being located on said first section, a second wall of said four walls being located on said second section, said second section being located on said shredder, a third wall and a fourth wall each being partially on said first section and partially on said second section, said third and fourth walls each being divided walls between the two sections.

18. A combination as claimed in claim 16, wherein said first section is supported by at least one vibration damper.

19. A combination as claimed in claim 18, wherein said first section is connected to said second section by said at least one vibration damper.

20. A combination as claimed in claim 19, herein said first section has a bottom that slopes downward to said second section.

21. A combination as claimed in claim 20, wherein said flexible barriers are brushes.

22. A combination as claimed in claim 21, wherein said second section has a lower edge with a flange extending outward therefrom, said flange being mounted on a frame of said shredder.

23. A combination as claimed in claim 22, wherein a plane along a bottom of said first section intersects an imaginary line where knives of said shredder begin to overlap one another.

* * * * *